US007542696B2

(12) United States Patent
Kotera et al.

(10) Patent No.: US 7,542,696 B2
(45) Date of Patent: Jun. 2, 2009

(54) DEVELOPING DEVICE AND IMAGE FORMING DEVICE EQUIPPED WITH SAME

(75) Inventors: Asami Kotera, Osaka (JP); Eiji Nimura, Osaka (JP)

(73) Assignee: Kyocera Mita Corporation, Osaka (JP)

( * ) Notice: Subject to any disclaimer, the term of this patent is extended or adjusted under 35 U.S.C. 154(b) by 398 days.

(21) Appl. No.: 11/306,379

(22) Filed: Dec. 27, 2005

(65) Prior Publication Data

US 2006/0198655 A1 Sep. 7, 2006

(30) Foreign Application Priority Data

Dec. 27, 2004 (JP) ..... 2004-377714

(51) Int. Cl.
*G03G 15/09* (2006.01)

(52) U.S. Cl. ..... 399/104; 399/277

(58) Field of Classification Search ..... 399/104, 399/277

See application file for complete search history.

(56) References Cited

U.S. PATENT DOCUMENTS 4,246,867 A * 1/1981 Hudson ..... 399/269
2004/0001727 A1* 1/2004 Akutsu ..... 399/104

FOREIGN PATENT DOCUMENTS

JP 2003/15411 A 1/2003

* cited by examiner

*Primary Examiner*—Ryan Gleitz
(74) *Attorney, Agent, or Firm*—Global IP Counselors, LLP

(57) ABSTRACT

A developing device is disclosed which includes a fixed magnet roller 25 having a plurality of magnetic poles, a development roller 27 having a development sleeve 26 that is supported axially with the ability to rotate freely, and a magnetic sealing member 29 arranged at the end of the longitudinal direction X of the development sleeve 26. Further, the length of each of the plurality of magnetic poles not facing the magnetic sealing member 29 (in other words, the development pole S1, lead-in pole N1, and blade pole N3) of the fixed magnet roller 25 are shorter than the length of each of the plurality of magnetic poles facing the magnetic sealing member 29. Accordingly, the magnetic toner retained on the peripheral surface of the development sleeve 26 is guided to the development area side in the longitudinal direction X of the development sleeve 26.

14 Claims, 6 Drawing Sheets

DEVELOPING DEVICE AND IMAGE FORMING DEVICE EQUIPPED WITH SAME

BACKGROUND OF THE INVENTION

1. Field of the Invention

The present invention relates to a developing device that uses developer to develop by means of an electrophotography development method, and more particularly to a developing device for preventing the scattering of developer outside the development area, and an image forming device equipped with same.

2. Background Information

Image forming devices such as printers, facsimiles, copying machines, etc. using an electrophotography development method are generally equipped with a photoreceptor and a developing device. An electrostatic latent image based on image data is formed on the surface of the photoreceptor, and a toner image is formed by developing this electrostatic latent image by means of a developing device that contains a developer.

Such conventional developing devices further provide a sealing member in order to prevent discharge of the toner outside of the development area. For instance, a magnetic sealing member formed from a magnetic substance has been used as the sealing member. This magnetic sealing member is provided with a fixed space in relation to the peripheral surface of the development sleeve at both ends of the longitudinal direction of the development roller. More specifically, for instance, as shown in Japanese Patent Application Publication No. 2003-15411, magnetic toner retained on the development sleeve by the magnetic force of a fixed magnet is restrained by the magnetic field formed in the gap between the end of the fixed magnet and the magnetic sealing member. This construction provides a seal which prevents magnetic toner from escaping by forming a magnetic brush composed particles of magnetic toner in the gap between the development sleeve and the magnetic sealing member.

However, one problem is that sufficient sealing capability will not be achieved with a construction which provides only the magnetic sealing member as described in the prior art. In other words, magnetic toner easily attaches to the peripheral surface of the development sleeve facing the internal end of the magnetic sealing member, because the magnetic force from the fixed magnet included in the development sleeve is concentrated generally within the internal end of the magnetic sealing member facing the peripheral surface of the development sleeve. Further, a member for controlling the thickness of the toner layer that extends towards the upper surface of the development sleeve (hereinafter, referred to as a "magnetic blade") has generally been provided in the developing device at the upper side of the development sleeve. However, as the developing operation is repeated, the toner layer thickens on the peripheral surface of the development sleeve facing the internal end of the magnetic sealing member, and a force is applied that pushes the magnetic toner retained on the peripheral surface of the development sleeve outside the development area in order to increase the pressure of the toner with respect to the magnetic blade. Therefore, when this pushing force becomes greater than the magnetic confinement of the magnetic sealing member, the magnetic toner cannot be completely prevented from escaping. Accordingly, the magnetic toner easily leaks outside the development area by slipping through the magnetic sealing member. As a result, sufficient sealing capability is not achieved when providing only a magnetic sealing member, and an inability to control the discharge flow of magnetic toner outside the development area is realized.

An object of the present invention is to provide a developing device capable of achieving a stable sealing over a long period of time with a simple construction, and an image forming device equipped with same.

SUMMARY OF THE INVENTION

According to a first embodiment of the present invention, a developing device comprises a development roller having a fixed magnet roller having a plurality of magnetic poles, and a rotatively supported development sleeve that serves to guide developer to the surface of a photoreceptor; and a magnetic sealing member arranged on an axial end of the development sleeve across a gap from the peripheral surface of the development sleeve, the magnetic sealing member serving to confine the developer by means of a magnetic field formed in the gap from the fixed magnet roller. The fixed magnet roller is formed so that the magnetic force created by the plurality of magnetic poles acts from the outer side to the inner side of the development sleeve in the axial direction.

According to the first aspect of the present invention, the magnetic force of the fixed magnet roller acts towards the development area side in the axial direction of the development sleeve. Accordingly, the discharge flow of the developer outside the development area can be effectively controlled, and stable sealing capability can be achieved over a long period of time, as a result of developer retained on the peripheral surface of the development sleeve being guided to the development area side in the axial direction of the development sleeve.

According to a second aspect of the present invention, in the developing device according to the first aspect, the axial length of each of the plurality of magnetic poles that do not face the magnetic sealing member is shorter than the axial length of each of the plurality of magnetic poles that face the magnetic sealing member.

According to the second aspect of the present invention, the discharge flow of developer outside the development area can be effectively controlled with a simple construction, and stable sealing capability can be achieved over a long period of time, as a result of enabling the developer retained on the peripheral surface of the development sleeve to be guided to the development area side in the axial direction of the development sleeve.

According to a third aspect of the present invention, in the developing device according to the second aspect, the axial length of each of the plurality of magnetic poles that do not face the magnetic sealing member are formed to be short from the upstream side to the downstream side of the rotation direction of the development sleeve.

According to the third aspect of the present invention, the discharge flow of the developer outside the development area can be effectively controlled in the same manner with a simple construction, and stable sealing capability can be achieved over a long period of time, as a result of enabling the developer retained on the peripheral surface of the development sleeve to be guided to the development area side in the axial direction of the development sleeve.

According to a fourth aspect of the present invention, in the developing device according to the second aspect, the length of each of the plurality of magnetic poles that do not face the magnetic sealing member are substantially the same. This also achieves the same operational effect described above.

According to a fifth aspect of the present invention, in the developing device according to the second aspect, the fixed magnet roller comprises a development pole having a first polarity and arranged near a development position, a lead-in pole having a second polarity that is opposite to the first polarity and adjacent to the development pole, a feeding pole having the first polarity and that is adjacent to the lead-in pole, a drawing pole having the second polarity that is adjacent to the feeding pole, a scatter prevention pole having the first polarity and that is adjacent to the drawing pole, and a blade pole having the second pole and that is adjacent to the scatter prevention pole.

According to a sixth aspect of the present invention, in the developing device according to the fifth aspect, the plurality of magnetic poles not facing the magnetic sealing member are the development pole, lead-in pole, and blade pole, and the plurality of magnetic poles facing the magnetic sealing member are the drawing pole, feeding pole, and scatter prevention pole.

According to a seventh aspect of the present invention, in the developing device according to the first aspect, wherein the magnetic sealing member is arranged such that the development sleeve is interposed between the magnetic sealing member and the photoreceptor.

According to an eighth aspect of the present invention, in the developing device according to the seventh aspect, the gap between the magnetic sealing member and the peripheral surface of the development sleeve is 0.1 mm to 1.0 mm.

According to a ninth aspect of the present invention, an image forming device uses developer to form an image on paper, and comprises an image forming device main unit; a paper supply unit arranged on a lower portion of the image forming device main unit; an image forming unit for forming a toner image on paper, the image forming unit comprising a photoreceptor; a paper feeding unit for feeding paper from the paper supply unit to the image forming unit; a fusing unit for fusing a toner image formed on the image forming unit onto paper; and a developing device. The developing device comprises a development roller comprising a fixed magnet roller having a plurality of magnetic poles, and a rotatively supported development sleeve that serves to guide developer to the surface of a photoreceptor; and a magnetic sealing member arranged on an axial end of the development sleeve across a gap from the peripheral surface of the development sleeve, the magnetic sealing member serving to confine the developer by means of a magnetic field formed in the gap from the fixed magnet roller. The fixed magnet roller is formed so that the magnetic force created by the plurality of magnetic poles acts from the outer side to the inner side of the development sleeve in the axial direction.

According to a tenth aspect of the present invention, in the image forming device according to the ninth aspect, the axial length of each of the plurality of magnetic poles that do not face the magnetic sealing member is shorter than the axial length of each of the plurality of magnetic poles that face the magnetic sealing member.

According to an eleventh aspect of the present invention, in the developing device according to the tenth aspect, the axial length of each of the plurality of magnetic poles that do not face the magnetic sealing member are formed to be short from the upstream side to the downstream side of the rotation direction of the development sleeve.

According to a twelfth aspect of the present invention, in the developing device according to the tenth aspect, the length of each of the plurality of magnetic poles that do not face the magnetic sealing member are substantially the same.

These and other objects, features, aspects and advantages of the present invention will become apparent to those skilled in the art from the following detailed description, which, taken in conjunction with the annexed drawings, discloses a preferred embodiment of the present invention.

BRIEF DESCRIPTION OF THE DRAWINGS

Referring now to the attached drawings which form a part of this original disclosure.

DETAILED DESCRIPTION OF THE PREFERRED EMBODIMENTS

Figure 1:
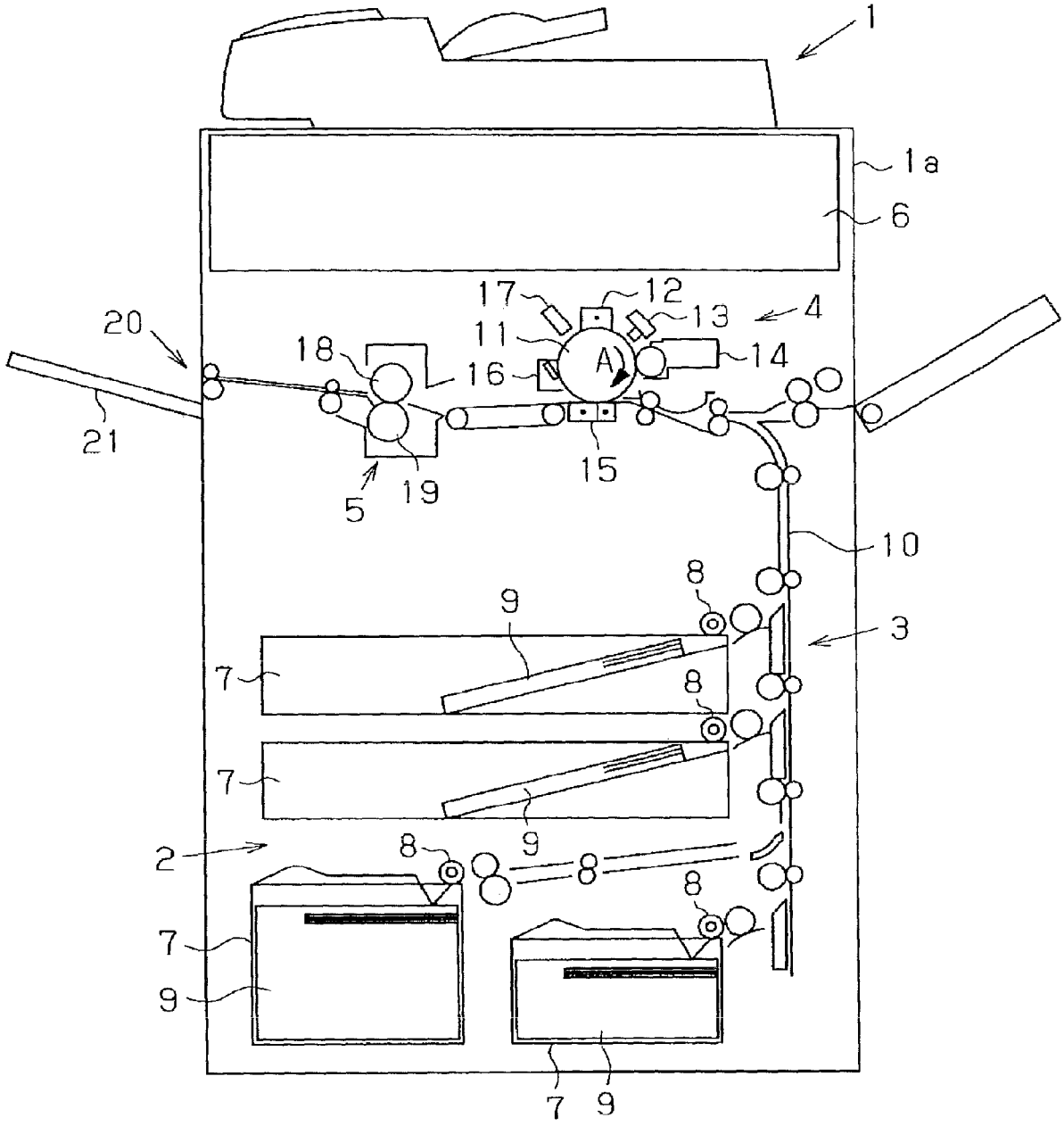
FIG. 1 is a schematic diagram showing the overall structure of an image forming device according to an embodiment of the present invention.

A detailed description of a preferred embodiment of the present invention is provided hereinafter with reference to the drawings. FIG. 1 is a schematic diagram showing the overall structure of an image forming device according to an embodiment of the present invention. As shown in FIG. 1, an image forming device 1 comprises a paper supply unit 2 arranged on the lower portion of an image forming device main unit 1*a*, a paper feeding unit 3 arranged to the side and above the paper supply unit 2, an image forming unit 4 arranged above the paper feeding unit 3, a fusing unit 5 arranged more to the discharge side than the image forming unit 4, and an image reading unit 6 arranged above the image forming unit 4 and the fusing unit 5.

The paper supply unit 2 comprises a plurality of paper supply cassettes 7 (four cassettes in this embodiment) where paper is placed, and a paper supply roller 8 provided above the paper supply unit 7. Paper 9 is delivered to the paper feeding unit 3 side by means of the rotation of the paper supply roller 8 from a paper supplying cassette 7 selected from the plurality of paper supply cassettes 7. The paper supply unit 2 is constructed so that paper 9 is reliably supplied to the paper feeding unit 3 one sheet at a time. In addition, the four paper supply cassettes 7 can be attached and removed at will with respect to the image forming device main unit.

The paper 9 supplied to the paper feeding unit 3 is fed towards the image forming unit 4 via a paper supply feed path 10. This image forming unit 4 forms a predetermined toner image on the paper 9 by an electrophotographic process, and comprises a photoreceptor 11 (an image carrier) arranged on a shaft to be freely rotatable in a predetermined direction (the direction indicated by the arrow A in the drawing), and in the vicinity of the photoreceptor 11 along the rotation direction thereof, an electrostatic charging device 12, an exposure device 13, a development device 14, a transfer device 15, a cleaning device 16, and a static eliminator device 17.

The electrostatic charging device 12 provides an electrostatic wire impressed with a high voltage, and the surface of the photoreceptor 11 is electrically charged uniformly by a predetermined electric potential given to the surface of the photoreceptor 11 by a corona discharge from the electrostatic wire. Through the exposure device 13, a light based on image data of an original document read by the image reading unit 6 is irradiated to the photoreceptor 11, thereby selectively attenuating the electric potential on the surface of the photoreceptor 11 and forming an electrostatic latent image on the surface of the photoreceptor 11. Next, the development device 14 adheres toner to the electrostatic latent image in order to form a toner image on the surface of the photoreceptor 11, and the toner image on the surface of the photoreceptor 11 is transferred by the transfer device 15 to the paper 9 supplied between the photoreceptor 11 and the transfer device 15.

The paper 9 onto which a toner image has been transferred is then fed to the fusing unit 5 from the image forming unit 4. The fusing unit 5 is placed on the down stream side of the paper feed direction of the image forming unit 4, and the paper 9 onto which a toner image has been transferred by the image forming unit 4 is heated and held between a heating roller 18 attached to the fusing unit 5, and a pressure roller 19 held down by the heating roller 18, to thereby adhere the toner image to the paper 9. The paper 9 having undergone image formation in the fusing unit 5 is then discharged onto a discharge tray 21 by the discharge roller pair 21. Meanwhile, the residual toner on the surface of the photoreceptor 11 after transcription is removed by the cleaning device 16, and the residual electric charge on the surface of the photoreceptor 11 is removed by the static eliminator device 17. The photoreceptor 11 is re-charged by the electrostatic charging device 12, and image formation can be performed thereafter in the same manner.

Figure 2:
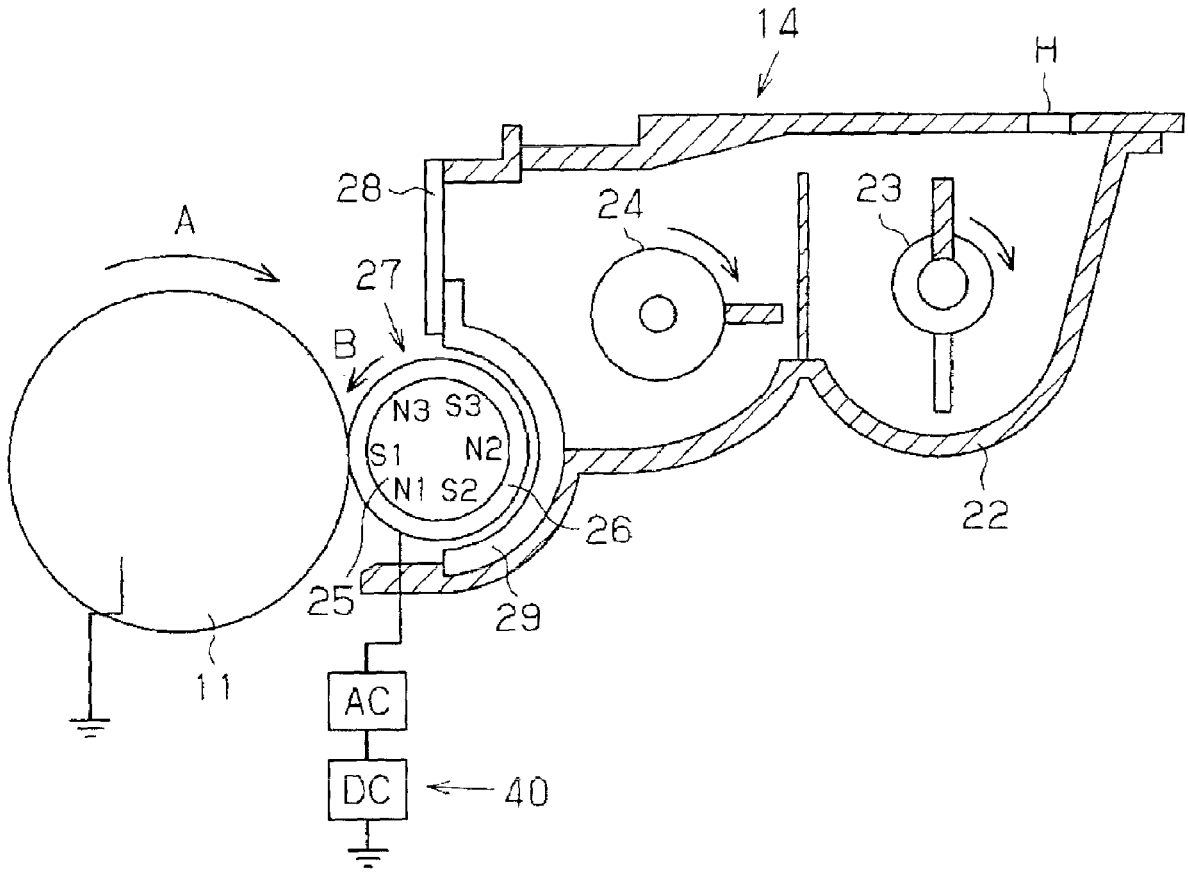
FIG. 2 is a cross-sectional view showing the developing device in an image forming device according to an embodiment of the present invention.

The developing device 14 according to the present embodiment, as shown in FIG. 2, comprises a development container 22 to store toner, and a pair of mixers 23 and 24 arranged within the development container 22. The developing device 14 further comprises a development roller (or toner carrier roller) 27 having a fixed magnet roller 25 and a development sleeve 26. The fixed magnet roller 25 is arranged at the drum opening side of the development container 22 and has a plurality of magnetic poles. The development sleeve 26 includes the fixed magnet roller 25, is supported axially so as to rotate freely and guide the stored toner on the surface of the photoreceptor 11, and is comprised of nonmagnetic member components. Furthermore, the developing device 14 comprises a magnetic blade 28, magnetic sealing member 29, and the developing bias device 40. The magnetic blade 28 is composed of a plate shaped magnetic material, and is provided in the vicinity of the development sleeve 26 so as to extend towards the surface of the development sleeve 26. The magnetic sealing member 29 is arranged on the end of the longitudinal direction (the direction indicated by the arrow X in the drawing), i.e., the axial direction of the development sleeve 26. The developing bias device 40 applies a bias voltage between the development roller 27 and the photoreceptor 11.

The toner refill hole H is opened on the surface of the development container 22 at the upper part of the mixer 23, and is constructed so as to allow the toner to be injected by means of a toner cartridge not shown in the drawing. The injected toner is guided to the development sleeve 26 by being stirred sufficiently by a pair of mixers 23 and 24. The toner guided to the development sleeve 26 is retained on the development sleeve 26 by using the magnetic force of the fixed magnet roller 25. The thickness of the layer of the retained toner on the development sleeve 26 is regulated by the magnetic blade 28, and acts as a thickness regulating member. Subsequently, the toner retained on the development sleeve 26 is guided to the development position, in other words, on the surface of the photoreceptor 11 by the development roller 27.

Although the development sleeve 26 is set at a predetermined rotational speed, the development sleeve 26 is set so as to rotate in the same direction (in other words, the direction indicated by the arrow B) between the drum and sleeve in relation to the rotation direction A of the photoreceptor 11 (see FIG. 2). Further, a developing bias voltage, with a low electric field in which a direct current component DC and an alternate current component AC are superposed, is applied to the development roller 27 by the developing bias device 40, and adjustment of image density is performed by controlling the AC oscillating frequency.

In addition, magnetic pole placement of the fixed magnet roller 25 places respectively, as shown in FIG. 2, a development pole S1 of the S pole in the vicinity of the developing position, a lead-in pole N1 adjacent to the development pole S1, a feeding pole S2 adjacent to the lead-in pole N1, with a drawing pole N2 adjacent to the feeding pole S2, a scatter prevention pole S3 adjacent to the drawing pole N2, and a blade pole N3 adjacent to the scatter prevention pole S3.

Figure 3:
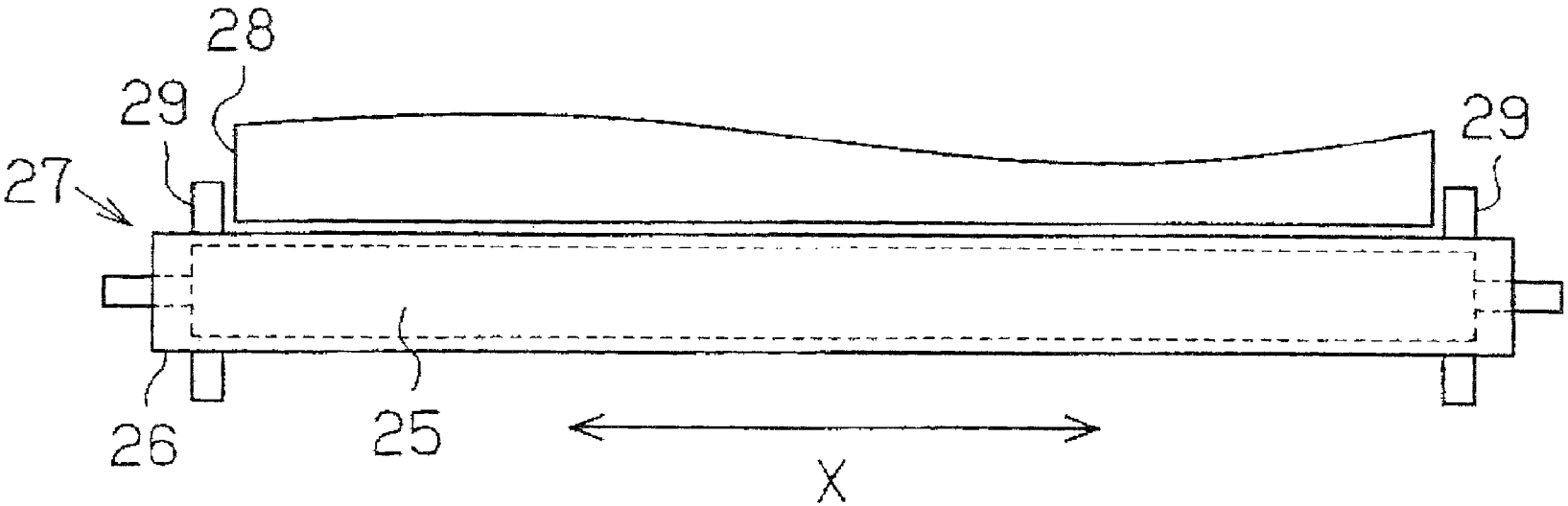
FIG. 3 is a frontal view when viewing the development roller provided in the developing device shown in FIG. 2 from the photoreceptor side.

Further, the magnetic sealing member 29 serves to prevent toner leakage from the end of the longitudinal direction of the development sleeve 26, and is arranged across a fixed space from the peripheral surface of the development sleeve 26 at both ends of the longitudinal direction of the development sleeve 26, as shown in FIG. 3. In addition, the space is set at 0.1 mm to 1.0 mm in the present embodiment.

The magnetic sealing member 29 is composed of a magnetic material (for instance, a magnet or ferromagnetic material), and the toner which is moved so as to flow outside from the end of the development sleeve 26 is confined by the magnetic field formed at the gap between the fixed magnet roller 25 and the magnetic sealing member 29. Further, a magnetic brush is formed by means of toner particles along each of the lines of magnetic force formed by the magnetic poles of the fixed magnet roller 25 and the magnetic poles of the magnetic sealing member 29. Furthermore, toner is prevented from flowing outside the development area by filling in the gap with the magnetic brush between the peripheral surface of the development sleeve 26 and the surface of the magnetic sealing member 29. In addition, the magnetic sealing member 29 is arranged on the opposite side from the photoreceptor 11 through the development sleeve 26 as shown FIG. 2 and FIG. 3.

As explained above, in a structure which provides only the magnetic sealing member 29, a force acts to repel the magnetic toner retained on the peripheral surface of the development sleeve 26 outside the development area when the development operation is performed repeatedly. Further, magnetic toner easily leaks out from the development area by slipping out of the magnetic sealing member 29 when the repelling force becomes greater than the magnetic confining force of the magnetic sealing member 29.

Figure 4:
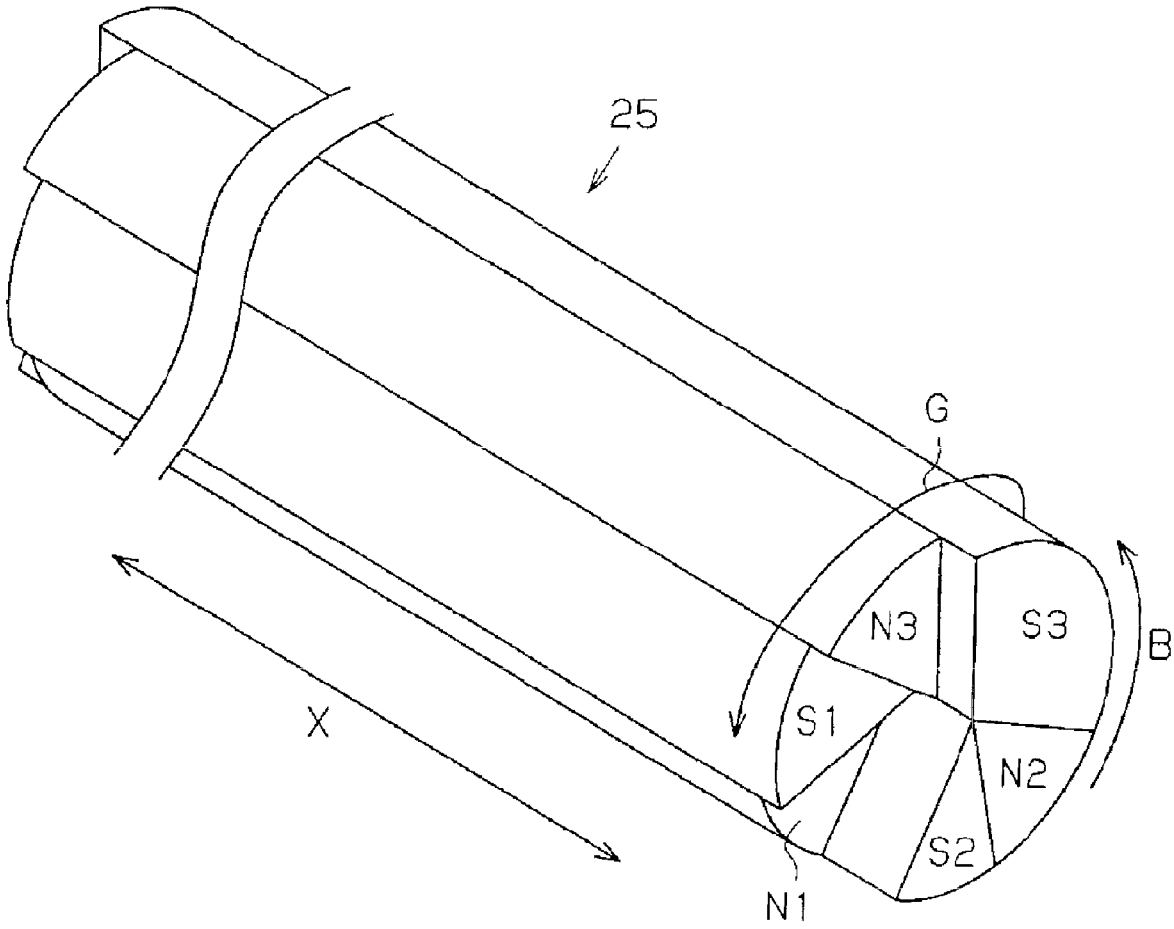
FIG. 4 is a diagonal view which explains the configuration of the fixed magnet roller in the developing device according to an embodiment of the present invention.
Figure 5:
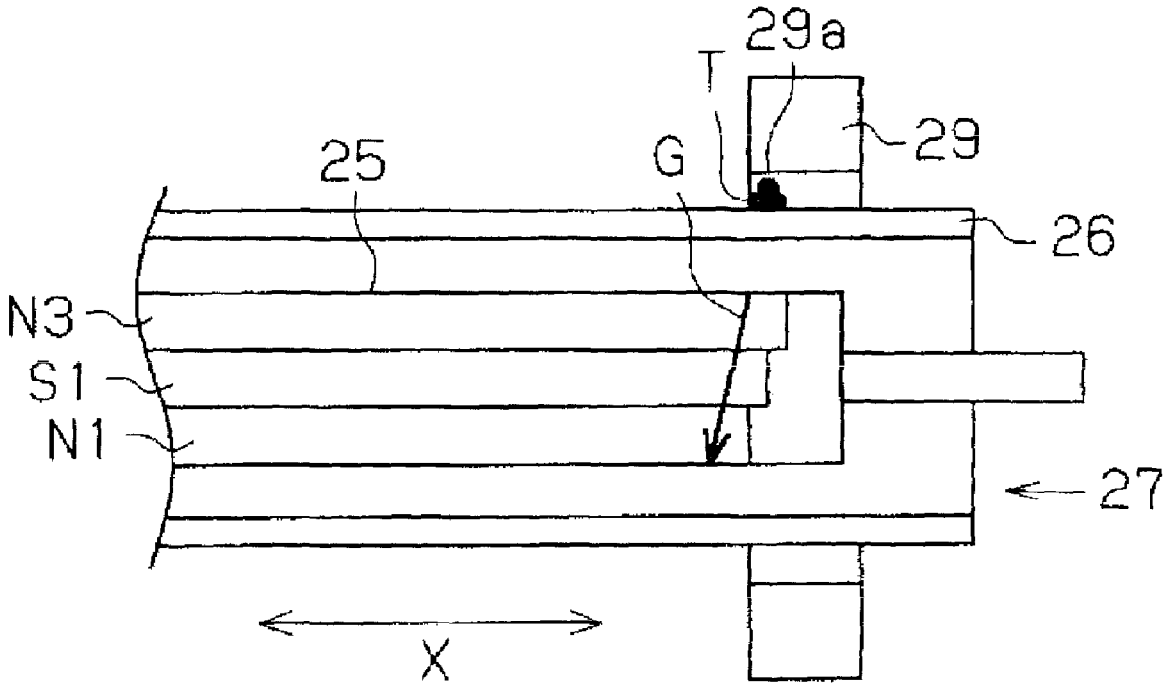
FIG. 5 is a sectional enlarged view which explains the magnetic operation of the fixed magnet roller in the developing device according to an embodiment of the present invention.

Accordingly, the present embodiment is constructed to effectively confine the discharge of magnetic toner outside the development area by arranging the magnetic sealing member 29 across a space from the peripheral surface of the development sleeve 26 at the end of the longitudinal direction X of the development sleeve 26, and devising the shape of the fixed magnet roller 25. A detailed description is given hereinafter with reference to the drawings. FIG. 4 is a perspective view used to explain the configuration of the fixed magnet roller in the developing device according to an embodiment of the present invention, and FIG. 5 is a sectional enlarged view to explain the magnetic force operation of the fixed magnet in the developing device according to an embodiment of the present invention.

The lengths of the magnetic poles not facing the magnetic sealing member 29 (in other words, the development pole S1, lead-in pole N1, and the blade pole N3) of the fixed magnet roller 25 in the longitudinal direction X of the development sleeve 26 in the present embodiment, as shown in FIG. 4, are constructed to be shorter than the lengths of the magnetic poles (in other words, the drawing pole N2, feeding pole S2, and the scatter prevention pole S3) facing the magnetic sealing member 29. Further, the length of the magnetic poles not facing the magnetic sealing member 29 are constructed in the longitudinal direction X of the development sleeve 26 so as to be shorter (in other words, the length of the blade pole N3>length of the development pole S1>length of the lead-in pole N1) from the upstream side to the downstream side of the rotation direction B of the development sleeve, as shown in FIG. 4 and FIG. 5.

By providing the fixed magnet roller 25, the magnetic force G of the fixed magnet roller 25, as shown in FIG. 4, acts from the outside to the inside in the longitudinal direction X of the development sleeve 26 (in other words, towards the development area side). Accordingly, the magnetic toner T retained on the peripheral surface of the development sleeve facing the inside end 29*a* of the magnetic sealing member 29, as shown in FIG. 5, is guided to the development area side in the longitudinal direction X of the development sleeve 26 by the magnetic force of the fixed magnet roller 25. Consequently, the magnetic toner T flowing outside the development area by slipping out of the magnetic sealing member 29 due to the repelling force by the development operation can be drawn back to the development area side. As a result, stable sealing capability can be exhibited over a long period of time with a simple construction, and effectively control the discharge of the magnetic toner T outside of the development area.

Figure 6:
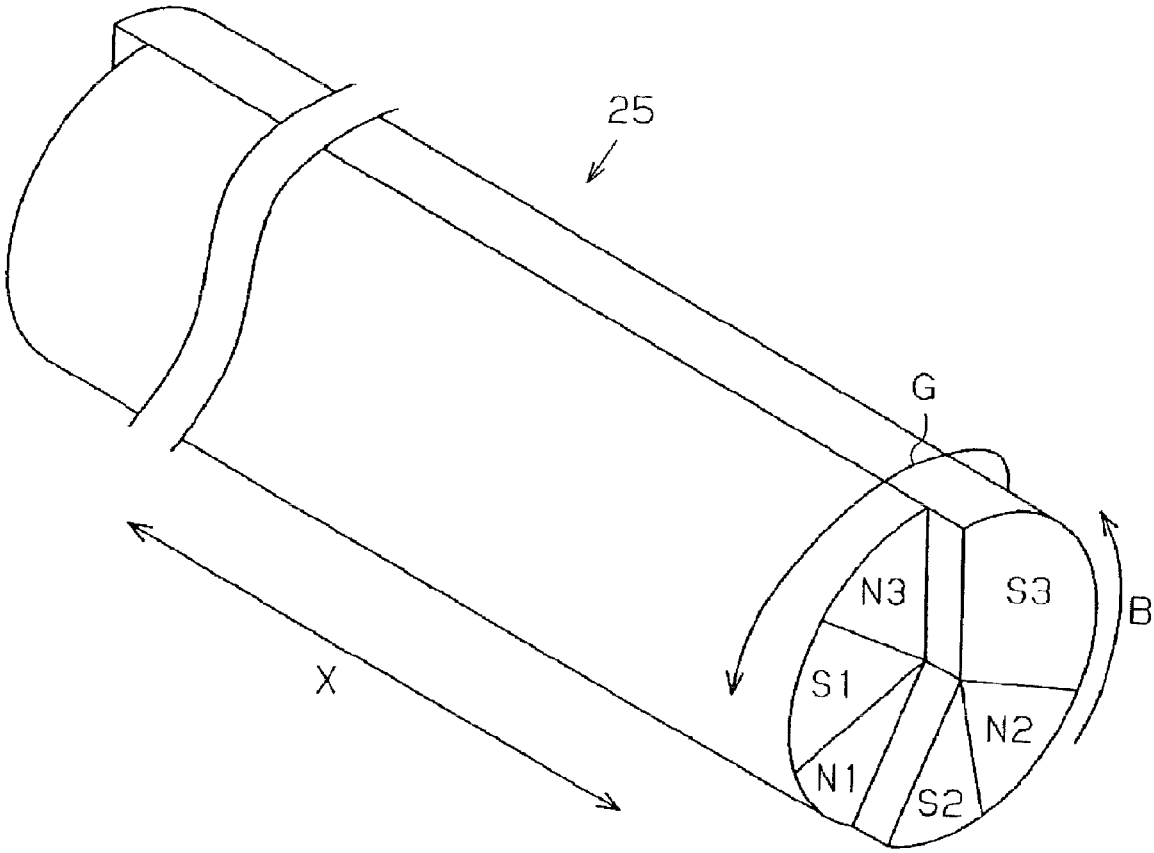
FIG. 6 is a diagonal view which explains a modified example of the fixed magnet roller in the developing device according to an embodiment of the present invention.

Note that, although the lengths of the magnetic poles not facing the magnetic sealing member 29 in the longitudinal direction X of the development sleeve 26 are constructed to be shorter from the upstream side to the downstream side in the rotation direction B of the development sleeve in the above embodiment, any construction may be acceptable if the magnetic toner flowing out of the development area can be drawn back to the development area side. For instance, each length of the magnetic pole not facing the magnetic sealing member 29 may be constructed to be nearly the same in the longitudinal direction X of the development sleeve 26 as shown in FIG. 6. Even when the configuration of the fixed magnet roller 25 is constructed in such manner, a similar operational effect can be obtained with the fixed magnet roller 25 shown in FIG. 4 described above.

The above embodiment shows a digital copying machine as an example of the image forming device, however it goes without saying that other image forming devices such as facsimiles or printers are also acceptable.

Furthermore, the present invention can also be applied to an image forming device that uses a two-component developer comprised of a toner and a carrier.

Any terms of degree used herein, such as "substantially", "about" and "approximately", mean a reasonable amount of deviation of the modified term such that the end result is not significantly changed. These terms should be construed as including a deviation of at least ±5% of the modified term if this deviation would not negate the meaning of the word it modifies.

This application claims priority to Japanese Patent Application No. 2004-377714. The entire disclosure of Japanese Patent Application No. 2004-377714 is hereby incorporated herein by reference.

While only selected embodiments have been chosen to illustrate the present invention, it will be apparent to those skilled in the art from this disclosure that various changes and modifications can be made herein without departing from the scope of the invention as defined in the appended claims. Furthermore, the foregoing description of the embodiments according to the present invention are provided for illustration only, and not for the purpose of limiting the invention as defined by the appended claims and their equivalents.

What is claimed is:

1. A developing device, comprising:

a development roller comprising a fixed magnet roller having a plurality of magnetic poles, and a rotatively supported development sleeve; and a sealing member being arranged on an axial end of the development sleeve across a gap from the peripheral surface of the development sleeve, the sealing member serving to confine the developer by a magnetic field formed in the gap from the fixed magnet roller, the fixed magnet roller being formed so that the magnetic force created by the plurality of magnetic poles acts from the outer side to the inner side of the development sleeve in the axial direction, and the axial length of each of the plurality of magnetic poles not facing the sealing member being shorter than the axial length of each of the plurality of magnetic poles facing the sealing member.

2. The developing device according to claim 1, wherein the axial length of each of the plurality of magnetic poles that do not face the sealing member are formed to be short from the upstream side to the downstream side of the rotation direction of the development sleeve.

3. The developing device according to claim 1, wherein the length of each of the plurality of magnetic poles that do not face the sealing member is substantially the same.

4. The developing device according to claim 1, wherein the fixed magnet roller comprises a development pole having a first polarity and arranged near a development position, a lead-in pole having a second polarity that is opposite to the first polarity and adjacent to the development pole, a feeding pole having the first polarity and that is adjacent to the lead-in pole, a drawing pole having the second polarity that is adjacent to the feeding pole, a scatter prevention pole having the first polarity and that is adjacent to the drawing pole, and a blade pole having the second pole and that is adjacent to the scatter prevention pole.

5. The developing device according to claim 4, wherein the plurality of magnetic poles not facing the sealing member are the development pole, lead-in pole, and blade pole, and the plurality of magnetic poles facing the sealing member are the drawing pole, feeding pole, and scatter prevention pole.

6. The developing device according to claim 1, wherein the sealing member is arranged such that the development sleeve is interposed between the sealing member and the photoreceptor.

7. The development device according to claim 6, wherein the gap between the sealing member and the peripheral surface of the development sleeve is 0.1 mm to 1.0 mm.

8. The developing device according to claim 1, wherein the rotatively supported sleeve serves to guide developer to the surface of a photo receptor.

9. The developing device according to claim 1, wherein the sealing member is a magnetic sealing member.

10. An image forming device which uses a developer to form an image on paper, comprising:

an image forming device main unit;

a paper supply unit being arranged on a lower portion of the image forming device main unit;

an image forming unit being arranged to form a toner image on paper, the image forming unit comprising a photoreceptor;

a paper feeding unit being arranged to feed paper from the paper supply unit to the image forming unit;

a fusing unit being arranged to fuse a toner image formed on the image forming unit onto paper; and a developing device comprising a development roller comprising a fixed magnet roller having a plurality of magnetic poles, and a rotatively supported development sleeve, and a sealing member being arranged on an axial end of the development sleeve across a gap from the peripheral surface of the development sleeve, the sealing member serving to confine the developer by a magnetic field formed in the gap from the fixed magnet roller, and the fixed magnet roller being formed so that the magnetic force created by the plurality of magnetic poles acts from the outer side to the inner side of the development sleeve in the axial direction, and the axial length of each of the plurality of magnetic poles not facing the sealing member being shorter than the axial length of each of the plurality of magnetic poles facing the sealing member.

11. The image forming device according to claim 10, wherein the axial length of each of the plurality of magnetic poles that do not face the sealing member is formed to be short from the upstream side to the downstream side of the rotation direction of the development sleeve.

12. The image forming device according to claim 10, wherein the length of each of the plurality of magnetic poles that do not face the sealing member is substantially the same.

13. The image forming device according to claim 10, wherein the rotatively supported sleeve serves to guide developer to the surface of a photo receptor.

14. The image forming device according to claim 10, wherein the sealing member is a magnetic sealing member.

* * * * *